United States Patent [19]

Najjar et al.

[11] Patent Number: 4,861,346

[45] Date of Patent: Aug. 29, 1989

[54] STABLE AQUEOUS SUSPENSION OF PARTIAL OXIDATION ASH, SLAG AND CHAR CONTAINING POLYETHOXYLATED QUATERNARY AMMONIUM SALT SURFACTANT

[75] Inventors: Mitri S. Najjar; Farokh Yaghmaie, both of Hopewell Junction; Louis S. Sorell, Carmel, all of N.Y.

[73] Assignee: Texaco Inc., White Plains, N.Y.

[21] Appl. No.: 141,445

[22] Filed: Jan. 7, 1988

[51] Int. Cl.[4] ..... C10L 1/32

[52] U.S. Cl. ..... 44/51; 44/72

[58] Field of Search ..... 44/51, 1 R, 1 SR, 70, 44/76, 72; 252/356, 357; 406/47, 49

[56] References Cited

U.S. PATENT DOCUMENTS

| | | | |
|---|---|---|---|
| 3,620,698 | 11/1971 | Schlinger et al. | 44/51 |
| 4,104,035 | 8/1978 | Cole et al. | 44/51 |
| 4,145,189 | 3/1979 | Solbakken | 44/51 |
| 4,363,637 | 12/1982 | Knitter et al. | 44/51 |
| 4,392,865 | 7/1983 | Grosse et al. | 44/51 |
| 4,398,918 | 8/1983 | Newman | 44/51 |
| 4,398,919 | 8/1983 | Zakaria | 44/51 |
| 4,417,902 | 11/1989 | Yaghmaie et al. | 44/51 |
| 4,536,186 | 8/1985 | Rey | 44/51 |
| 4,666,462 | 5/1987 | Martin | 44/51 |
| 4,704,134 | 11/1987 | Meyer et al. | 44/51 |

FOREIGN PATENT DOCUMENTS

| | | | |
|---|---|---|---|
| 57-168993 | 10/1982 | Japan | 44/51 |

*Primary Examiner*—William R. Dixon, Jr.
*Assistant Examiner*—Margaret B. Medley
*Attorney, Agent, or Firm*—Robert A. Kulason; James J. O'Loughlin

[57] ABSTRACT

A pumpable stable aqueous suspension of ash, slag, and char particulate matter produced by the partial oxidation of a carbonaceous charge fuel comprises 1.0–50.0 wt. % particulate matter selected from the group consisting of ash, slag, and char and mixtures thereof, water, and about 0.1–10.0 wt % of an alkyl substituted amino based surfactant selected from the group consisting of alkyl-substituted aminobutyric acid, alkyl-substituted polyethoxylated amide and alkyl-substituted polyethoxylated quarternary ammonium salt.

3 Claims, No Drawings

STABLE AQUEOUS SUSPENSION OF PARTIAL OXIDATION ASH, SLAG AND CHAR CONTAINING POLYETHOXYLATED QUATERNARY AMMONIUM SALT SURFACTANT

BACKGROUND OF THE INVENTION

1. Field of the Invention

This invention relates to a stable aqueous suspension of particulate matter selected from the group consisting of ash, slag, and char, and mixtures thereof, which are produced in a partial oxidation process. More particularly, it pertains to a novel pumpable stabilized aqueous suspension comprising an alkyl-substituted amine-based surfactant and particulate matter selected from the group consisting of ash, slag, and char, and mixtures thereof, that are produced by quench cooling or scrubbing a raw effluent gas stream from a process for the partial oxidation of solid carbonaceous fuel.

2. Information Disclosure Statement

Solid carbonaceous fuels such as coal, petroleum coke, shale, asphalt, etc. have been dispersed in liquid mediums such as water and liquid hydrocarbons to form pumpable slurries. These slurries have been introduced as feedstock into partial oxidation gas generators in processes disclosed for example in coassigned U.S. Pat. Nos. 3,544,291; 3,620,698; 4,104,035; 4,265,407; and 4,328,008.

It is well known to those skilled in the art that the partial oxidation of solid carbonaceous fuels such as coal, petroleum coke, hale, asphalt, etc. produces synthesis gas comprising primarily $H_2$ and CO as well as particulate ash which primarily comprises inorganic slag and carbonaceous char material. This particulate material may be discharged from the partial oxidation process for eventual disposal or recycled in part or in whole to the partial oxidation reactor as a charge fuel either alone or in admixture with other solid carbonaceous charge fuel material, in order to: (1) achieve the partial oxidation of the remaining carbonaceous material (i.e. char); and (2) utilize the inorganic compounds contained within the slag as a fluxing agent to improve solids removal from the partial oxidation reactor. It would therefore be advantageous to have a stable aqueous suspension of a slag and char mixture for pumping, either for disposal of the material or for partial or total recycle of the slag and char to the partial oxidation reactor. Stable liquid suspensions comprising carbonaceous material are disclosed, for example, by the following:

Coassigned (Najjar et al.) U.S. patent application Ser. No. 674,898, filed Nov. 26, 1984 discloses a stable aqueous suspension of slag, fly-ash and char which comprises 1.0–50.0 wt. % of particulate matter selected from the group consisting of slag, fly-ash, char and mixtures thereof and 0.1–10.0 wt. % of a surfactant which is an anionic or nonionic adduct of an alkyl phenol and polyoxyalkylene or polyoxy propylene;

(Koskan et al.) U.S. Pat. No. 4,530,701 discloses a process of manufacturing a coal-fuel composition which comprises coal macro particles in a petroleum liquid fuel, water, an alkaline fluxing mineral material, and a coal anti-sedimentation surfactant which is a fatty acid alkenol amide;

(Mark) U.S. Pat. No. 4,478,603 discloses a stabilized high solids content coal-aqueous mixture comprising water, coal, a polyalkylene oxide nonionic surfactant and a polyelectrolyte surfactant;

(Meyer) U.S. Pat. No. 4,475,924 discloses a liquid-solid fuel composition comprising beneficiated coal char derived from the pyrolytic destructive thermal distillation of coal in the absence of oxygen, and a $C_1$–$C_4$ alcohol.

Co-assigned (Wiese et al.) U.S. Pat. No. 4,304,572 discloses a pumpable coal-water slurry comprising coal present in a concentration of at least 50% by weight, $NH_4OH$ present in an amount between 0.1–5.0 wt. %, and an anionic surfactant comprising a salt of an organic sulfonic acid present in an amount between 0.01–3.0 wt. %;

(Grosse et al.) U.S. Pat. No. 4,392,865 discloses a stabilized hydrocarbon-water fuel comprising coal, oil, a relatively low molecular weight hydrophilic-lipophilic agent, and a high molecular weight swellable material, having a molecular weight of at least 500,000;

(Solbakken) U.S. Pat. No. 4,145,189 discloses a clean burning, low sulfur liquid fuel suspension which comprises coal char and liquid oil derived from a pyrolysis process, water, and an optional stabilizing agent;

Co-assigned (Cole et al.) U.S. Pat. No. 4,104,035 discloses a solid fuel-water slurry suitable for use as feed to a partial oxidation reactor which comprises hydrothermally treated subbituminous coal and lignite, water, and a surfactant which is a salt of an organic sulfonic acid; and (Thomas) U.S. Pat. No. 4,094,810 discloses a process for producing an aqueous slurry of an ash concentrate composition comprising insoluble coal products, the process comprising mixing water, insoluble coal products derived from a coal deashing process, and an anionic or nonionic surfactant.

It is the object of this invention to provide a pumpable aqueous suspension of slag and char derived from a partial oxidation process, the suspension having reduced viscosity and increased resistance to sedimentation.

It is one feature of this invention that such a pumpable aqueous suspension facilitates disposal of slag and char material or the recycling of such material to the partial oxidation reactor.

The instant invention is advantageous in that suspensions of the instant invention show improved stability and resistance to settling over aqueous suspensions of partial oxidation process slag and char which do not contain the abovedescribed surfactant material.

SUMMARY OF THE INVENTION

In accordance with the invention there is provided a pumpable stable aqueous suspension of particulate matter produced when solid carbonaceous fuel is gasified in a partial oxidation gas generator to produce a raw effluent gas mixture of $H_2$ and CO. The particulate matter is ash, which comprises primarily inorganic slag and primarily carbonaceous char, and mixtures thereof. The aqueous suspension is produced by quench cooling or scrubbing the raw effluent gas stream with water. The aqueous suspension has a reduced viscosity and increased resistance to sedimentation. It may have a solids content of about 1.0–50.0 wt. % of particulate matter selected from the group consisting of ash, slag, and char, and mixtures thereof, water, and about 0.1–10.0, preferably 0.5–2.0 wt. % of an alkyl-substituted amine-based surfactant selected from the group consisting of alkyl-substituted aminobutyric acid, alkyl-substituted polyethoxylated amide, and alkyl-substituted polyethoxylated quaternary ammonium salt. Suspensions of the instant invention are particularly useful in facilitating disposal of slag and char material from the partial oxidation process, or facilitating recycle of slag and char material to the partial oxidation reactor for further conversion of the carbonaceous material, and utilization of inorganic material contained within the slag as a fluxing agent to increase the efficiency of solids removal within the partial oxidation reactor.

DETAILED EMBODIMENTS OF THE INVENTION

Synthesis gas, reducing gas and fuel gas comprising mixtures of $H_2$, CO and various amounts of other gases may be made by the partial oxidation process, such as described in coassigned U.S. Pat. Nos. 3,544,291, 3,998,609 and 4,289,502, which are incorporated herein by reference. Advantageously, the partial oxidation process may use as feedstock comparatively low-cost readily available solid carbonaceous fuels. For example, the following solid carbonaceous fuels are suitable feedstocks: coal, i.e. anthracite, bituminous, subbituminous, and lignite; particulate carbon; coke from coal; petroleum coke; coal liquefaction solid residues; oil shale; tar sands; asphaltic bitumen; and mixtures thereof. In the partial oxidation process, ground solid fuel is introduced into the gas generator either alone or in the presence of a substantially thermally vaporizable hydrocarbon and/or water, or entrained in a temperature moderator such as steam, $CO_2$, $N_2$ and recycle synthesis gas. The term free-oxygen containing gas, as used herein, recycle synthesis gas. The term free-oxygen containing gas, as used herein is intended to include air, oxygen-enriched air, i.e. greater than 21 mole % oxygen, and substantially pure oxygen, i.e. greater than 95 mole % oxygen (the remainder comprising $N_2$ and rare gases).

Entrained in the hot raw gas stream leaving the reaction zone of the gas generator at a temperature in the range of about 1700° to 3000° F. is ash comprising slag and char, and mixtures thereof. The particle size of the ash is in the range of about 37 to 2000 microns, such as about 44 to 500 microns. The concentration of solids in the hot raw gas stream may be in the range of about 0.1 to 4 grams per standard cubic foot (SCF). The composition will depend upon the type of solid carbonaceous fuel and the temperature and operating conditions of the partial oxidation gas generator. By definition, ash in the raw gas stream is the remnants of completely combusted particles of the solid carbonaceous fuel, and comprises slag and char. Slag is substantially inorganic molten ash which has typically solidified into glassy particles. Slag particles are remnants of completely burnt coal particles or slurry droplets and represent the fused mineral matter of the solid carbonaceous fuel feed. The content of mineral matter in a typical solid carbonaceous fuel in weight percent may be about 0.2 for petroleum coke and 20.0 for coal. Slag may also contain heavy metal constituents originally present in the feed. The size of coarse solid particles of slag is greater than about 841 microns, such as up to about 2000 microns; and the size of fine solid particles of slag is a fraction thereof. Char is the devolatilized and partially combusted solid carbonaceous fuel particles comprising 2–65 wt. % carbon, some inorganic material (e.g. mineral matter and metals), and a little, if any, hydrogen and sulfur. Char particles are porous and the size is typically below 841 microns. The amount of char in the effluent gas stream may be decreased by increasing the temperature of the reaction zone.

The hot raw effluent gas stream exits from the partial oxidation gas generator and may be cooled to a temperature in the range of about 60° to 950° F., such as less than about 350° F. For example, the hot gas stream may be first partially cooled by direct contact with water contained in a quench tank, such as shown in coassigned U.S. Pat. No. 4,218,312 which is incorporated herein by reference. Molten slag is solidified by the quench water and most of the slag and char are transferred to the water in the quench tank. The partially cooled gas stream may be then passed through a water scrubbing operation to remove any remaining entrained particulate matter. The pressure in the quench tank is substantially the same as the gas generator located above. A portion of the quench water at the bottom of the quench tank is removed by way of a lock hopper 37 and settler 40 as shown in the drawing for coassigned U.S. Pat. No. 3,544,291. The aqueous suspensions of particulate matter from the group consisting of slag, char, and mixtures thereof in lines 39, 41 and 42 of U.S. Pat. No. 3,544,291 have solids concentrations in the range of about 1.0 to 50.0 wt. %, such as about 10 to 20 wt. %. For example, the overflow stream in line 41 of the drawing in coassigned U.S. Pat. No. 3,544,291 may have a solids content of particulate matter in the range of about 1.0–4.0 wt. % and a particle size in the range of about 37 to 2000 microns. The underflow in line 42 may have a solids content of particulate matter in the range of about 5 to 50 wt. % and a particle size of up to about 2000 microns or more.

Another stream of quench water carrying fine particles exits the gasifier quench chamber or pool of water 27 of U.S. Pat. No. 3,544,291 by way of line 43 in response to a liquid level controller and is directed to settler 40. The aqueous suspension in line 43 and the gas scrubbing water from line 31 may have about 0.2 to 4.0 wt. % solids substantially comprising fine slag and char with a particle size in the range of about 37.0 to 1000 microns. On the way to the settler, the heat content of the aqueous suspension of particulate matter consisting of slag, char, and mixtures thereof may be reduced by indirect heat exchange in a heat exchanger (not shown). Advantageously by the subject invention, fouling of tubes and heat exchanger surfaces by the particulate matter precipitating out is avoided. Alternatively, the hot raw effluent gas stream from the reaction zone may be partially cooled, by indirect heat exchange, prior to being scrubbed with water, by being passed through a radiant or convection gas cooler. Ash and coarse and fine particles of slag and char may pass from the water sump of the gas cooler and are collected in a lock hopper vessel, such as shown in coassigned U.S. Pat. No. 4,377,132 which is incorporated herein by reference. The solids and water from the lock hopper may flow by gravity into a water sump or settler where optionally the coarse particulate solids may be removed by screens thereby producing a dispersion of fine particulate solids as described previously.

Mixing of the dispersions of particulate solids from the groups slag and char, and mixtures thereof in quench and/or scrubbing water with the alkyl-substituted amine-based surfactant may take place, for example, in the following manner: (1) in a gravity settling tank or clarifier, at a temperature in the range of about 60° to 250° F., such as about 150° to 200° F.; (2) in the quench water tank located below the reaction zone of the partial oxidation gas generator, at a temperature in the range of about 60° to 700° F., such as about 250° to 450° F.; or (3) by means of a static mixer located in a pipeline leading to a settler or other conventional solids-liquid separator, at a temperature in the range of about 60° to 250° F., such as about 150° to 200° F. The in-line static mixer comprises a free-flow cylindrical conduit which encloses a plurality of fixed helical-shaped curved sheet-like elements that extend longitudinally in series. Flow division and radial mixing occur simultaneously within the conduit. There are no moving parts nor external power requirements.

The instant invention deals with stable aqueous suspensions of particulate matter selected from the group consisting of slag, char, and mixtures thereof which contain a surfactant, are pumpable, and have a low viscosity and reduced sedimentation rate in comparison with other aqueous suspensions of said particulate matter with the same solids content but without the prescribed surfactant. A stable suspension of said particulate matter in water is desired for transportation and processing. Fast sedimentation of slag and char particles can cause operational difficulties. The suspensions may be used to recycle char and slag back to the partial oxidation reactor for further conversion of the carbonaceous material contained therein, and to utilize the slag as a fluxing agent for molten slag in the partial oxidation reactor. The excellent pumpability of the subject suspensions permits them to be transported long distances by pipeline without the solids settling out. The suspensions also make excellent additives for ash-containing solid carbonaceous fuel feedstocks for the partial oxidation process. The particulate matter will combine with the ash in the solid carbonaceous fuel to produce a low melting eutectic. By this means the gasifier may be run at a lower temperature, thereby extending the life of the refractory lining the reaction zone. Further, the particulate matter will not settle out and clog the narrow passes in the heat exchangers.

Aqueous suspensions of the instant invention comprise 0.1–10.0 wt. %, preferably 0.5–2.0 wt. % of an alkyl-substituted amine-based surfactant selected from the group consisting of alkyl-substituted aminobutyric acid, alkyl-substituted polyethoxylated amide, and alkyl-substituted polyethoxylated quaternary ammonium salt.

The alkyl-substituted aminobutyric acid surfactant is preferably selected from the group consisting of N-coco-beta-aminobutyric acid, N-tallow-beta-aminobutyric acid, N-lauryl-beta-aminobutyric acid, and N-oleyl-beta-aminobutyric acid. N-coco-beta-aminobutyric acid is particularly preferred for use as the alkyl-substituted aminobutyric acid surfactant in the aqueous suspension of the instant invention. A commercially available example of such an aminobutyric acid is ARMEEN Z (available from the Armak Company).

The alkyl-substituted polyethoxylated amide surfactant is preferably an N, N-substituted fatty amide, with the substituents being 1-50 polyoxyethylene groups. Alkyl-substituted polyethoxylated amides particularly suitable for use may be selected from the group consisting of polyoxyethylene oleamide, polyoxyethylene tallowamide, polyoxyethylene laurylamide, and polyoxyethylene cocoamide, with 5–50 polyoxyethylene moieties being present. Commercially available polyethoxylated amides suitable for use are available from the Armak Company under the ETHOMID series trade name.

The alkyl-substituted polyethoxylated quaternary ammonium salt surfactant is preferably of the formula

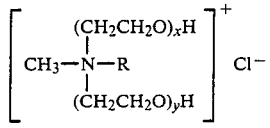

where R is an alkyl radical selected from the group consisting of coco, tallow, lauryl, oleyl, and octadecyl, and x+y has a value in the range of 2–15. Examples of commercially available polyethoxylated quaternary ammonium salts for use as surfactants in the aqueous suspension of the instant invention are those available from the Armak Company under the ETHOQUAD series trade name, such as methylbis (2-hydroxyethyl) cocoammonium chloride (ETHOQUAD C/12) (x+y=2), methylpolyoxyethylene cocoammonium chloride (ETHOQUAD C/25) (x+y15), methylbis (2-hydroxyethyl) oleylammonium chloride (ETHOQUAD O/12) (x+y=2), methylpolyoxyethylene oleylammonium chloride (ETHOQUAD O/25) (x+y=15), methylbis (2-hydroxyethyl) octadecylammonium chloride (ETHOQUAD 18/12) (x+y=2), and methylpolyoxyethylene octadecylammonium chloride (ETHOQUAD 18/25) (x+y=15). Methylbis (2-hydroxyethyl) octadecylammonium chloride (ETHOQUAD 18/12) is particularly preferred, and may be represented by the formula

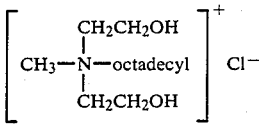

The following examples illustrate the subject invention and should not be construed as limiting the scope of the invention.

EXAMPLES

Aqueous suspensions of Texaco Coal Gasification Process TCGP) slag having a solids concentration of about 7.4 wt. % and having a particle size of ASTM E-11 Standard Sieve Designation 45 microns (−325 mesh) were studied with and without the abovedescribed alkyl-substituted amine based surfactants. Batch settling tests were run on the suspensions with and without the surfactants. The results reported in Table I below for a suspension without surfactant show that TCGP slag from Illinois #6 Coal settled out rapidly. For example, the clear interface level dropped to about 50% of the original level in 540 seconds. The sedimentation rates for the aqueous suspension of particulate matter were measured by means of a vertical column 10 cm high×1 cm I.D. at room temperature. The height (cm) of supernatant fluid (clear water) above the level for the aqueous suspension of TCGP slag from Illinois #6 Coal was measured with time. In contrast, as shown in Table II, there was substantially no settling of solids with time for those suspensions of TCGP slag from Illinois #6 Coal containing 1.8 wt. % of the prescribed alkyl-substituted amine-based surfactant.

TABLE I

| BATCH SETTLING (NO SURFACTANT) TCGP SLAG FROM ILLINOIS #6 COAL | |
|---|---|
| Height of Interface (cm) | Time Sec. |
| 9.8 | 40 |
| 6.5 | 240 |
| 5.9 | 300 |
| 4.3 | 540 |
| 3.4 | 900 |

TABLE II

| BATCH SETTLING WITH SURFACTANTS | | | |
|---|---|---|---|
| Surfactant (wt. %) | Type of Solids Suspended | Interface Height (cm) | Time (Sec.) |
| N—coco-beta-amino-butyric acid (ARMEEN Z) | TCGP slag from Illinois #6 Coal | 9.8 | 60 |
| | | 9.8 | 120 |
| | | 9.8 | 180 |
| | | 9.8 | 240 |
| | | 9.8 | 300 |
| Methylbis (2-hydroxy-ethyl) octadecyl ammonium chloride (ETHOQUAD 18/12) | TCGP slag from Illinois #6 Coal | 9.8 | 300 |
| | | 9.8 | 420 |
| | | 9.8 | 540 |
| | | 9.8 | 600 |
| | | 9.8 | 720 |
| | | 9.8 | 950 |
| | | 9.8 | 1020 |
| | | 9.8 | 1500 |
| | | 9.8 | 1800 |
| Polyoxyethylene tallowamide (ETHOMID HT/23) | TCGP slag from Illinois #6 Coal | 9.8 | 120 |
| | | 9.8 | 180 |
| | | 9.8 | 240 |
| | | 9.8 | 360 |
| | | 9.8 | 600 |
| | | 9.8 | 720 |

Other modifications and variations of the invention as hereinbefore set forth may be made without departing from the spirit and scope thereof, and therefore only such limitations should be imposed on the invention as are indicated in the appended claims.

We claim:

1. A pumpable aqueous suspension of particulate matter with reduced viscosity and increased resistance to sedimentation and having a particle size in the range of about 37–2000 microns as produced by quench cooling or scrubbing the hot raw effluent gas stream comprising $H_2+CO$ at a temperature in the range of about 1700° F.–3000° F. from the partial oxidation of solid carbonaceous fuel selected from the group consisting of anthracite, bituminous, sub-bituminous and lignite coal, coke from coal, petroleum coke, coal liquefaction solid residue, oil shale, tar sands, asphaltic bitumen, and mixtures thereof, wherein said aqueous suspension comprises water, about 1.0–50.0 weight percent of said particulate matter consisting of a mixture of slag and char, and about 0.1–10.0 weight percent of a polyethoxylated quaternary ammonium salt surfactant of the formula:

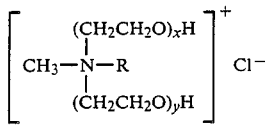

where R is an alkyl radical selected from the group consisting of coco, tallow, lauryl, oleyl, and octadecyl, and x+y has a value in the range of 2–15.

2. The aqueous suspension of claim 1, where said particulate matter has a particle size in the range of 44–500 microns.

3. The aqueous suspension of claim 1, where said surfactant is of the formula

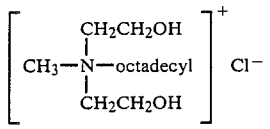

and is present in a concentration range of 0.5–2.0 weight percent.

* * * * *